United States Patent [19]

Lydon

[11] 4,212,407

[45] Jul. 15, 1980

[54] FIRE EXTINGUISHING WASTE RECEPTACLE

[76] Inventor: Bart J. Lydon, 910 Freeport Blvd., Sparks, Nev. 89431

[21] Appl. No.: 873,388

[22] Filed: Jan. 30, 1978

[51] Int. Cl.[2] ..... B65D 25/00

[52] U.S. Cl. ..... 220/88 R; 220/1 T; 220/334

[58] Field of Search ..... 220/88 R, 1 H, 1 T, 220/256, 334, 259, 207

[56] References Cited

U.S. PATENT DOCUMENTS

| | | | |
|---|---|---|---|
| 1,238,993 | 9/1917 | Edwards | 220/334 |
| 1,873,029 | 8/1932 | Putterman | 220/1 H |
| 2,125,122 | 7/1938 | Mongiello | 220/334 |
| 2,802,538 | 8/1957 | Subarsky | 220/88 R X |
| 3,182,727 | 5/1965 | Minton | 220/88 R X |
| 3,394,832 | 7/1968 | McAllister et al. | 220/1 T |
| 3,904,070 | 9/1975 | Lisciani et al. | 220/1 H X |

*Primary Examiner*—Steven M. Pollard

*Attorney, Agent, or Firm*—Poms, Smith, Lande & Rose

[57] ABSTRACT

The waste receptacle cover has an upper portion and a lower portion. The upper portion has a swinging top which, along with the supports for the top, cover the top of the waste receptacle. Depending from the upper portion is a lower portion including a baffle which has walls angled toward the center of the container and generally vertical walls depending from the angled walls. The vertical walls create an opening so that waste dropped through the upper portion when the top is swung open can fall through the opening. The angled walls and the vertical walls together create a baffle that directs combustion products back down onto waste within the container if a fire starts and prevents oxygen from reaching the fire. The bottom of the swinging top may be closed to further restrict the amount of oxygen within the container. The connection between the upper portion and the lower portion includes a guide for camming the cover into place on top of the waste receptacle.

4 Claims, 5 Drawing Figures

20
II
33
32
-50-
30
17
48
31
35
33
68
66
74
10
II
11
13

73
70
46
-72-
41
74
66
68
70
71
45
39

IV
40
51
50
30
48
20
54
-53-
-52-
56
56
36
57
61
35
38
38
37
37
17
41
III
41
III
17
-32-
70
39
-31-
70
15
46
16
16
59
46
58
45
59
71
-67-
-66-
69
65
71
68
73
73
14
74
75
74
75
60
IV
-12-
-11-
13
10
72

FIRE EXTINGUISHING WASTE RECEPTACLE

BACKGROUND OF THE INVENTION

This invention is primarily concerned with waste receptacles that minimize the dangers of fire. It is speculated that much property damage, personal injury and even death are caused by fires which take place in waste receptacles. The main cause of such fires is the introduction of burning or smoldering material into the container, but it is believed that some fires are started by spontaneous combustion caused by rapid oxidation of materials which raises them above their kindling temperature.

Covers have been proposed for waste containers which direct the combustion products back onto the material effectively preventing air and oxygen from reaching it. The flow of combustion products also has the effect of blocking the flow of oxygen into the container. Examples of these covers are shown in U.S. Pat. Nos. 3,904,070, 3,182,727 and 2,802,538.

Many waste containers have tops or covers. They shield the contents from vermin and also shield the contents from view. Some covers also trap the odors of the waste.

A wide variety of covers have been proposed. Some lock onto the top of the container and must be removed when depositing waste. Sliding or sprung doors are also somewhat common. Another type that has gained popularity is the swinging top model. The top is suspended from pivots and in its normal position covers the opening. Pushing on the top from either side pivots it and exposes the inside of the container so that a person holding the waste in one hand can push the swinging top with the hand and drop the contents while he is pivoting the top. The weight of the top causes it to return to its normal position over the opening.

One of the objects of the present invention is to disclose and provide a waste receptacle cover which not only covers the waste container but prevents or stops fires that might occur within the container. Other objects of the present invention include providing a waste container with such a cover which can easily be removed so that the contents of the container can be emptied, providing the cover with means so that it can be easily replaced on the container without having to be forced or aligned, having a cover that can be relatively easily constructed, and having a generally low-cost and yet effective cover which is reliable in stopping or substantially slowing fires.

Another principal object of the invention is to have a cover for a waste receptacle with two portions, an upper portion which resembles a conventional waste container cover having a swinging top to provide access to the opening and a lower portion having a combustion product directing baffle which directs combustion products back down onto the flammable material. The upper portion and the lower portion cooperate with each other in such a way that the swinging top also limits the rate at which oxygen can reach the fire, and the upper portion also supports the lower portion so that it can be easily inserted and withdrawn from the container.

Other objects will become apparent in the following disclosure, and it will be shown that the present invention meets the objects.

BRIEF DESCRIPTION OF THE DRAWINGS

FIG. 2 shows both the upper portion and the lower portion of the cover.

DETAILED DESCRIPTION OF THE PREFERRED EMBODIMENT

Figure 1:
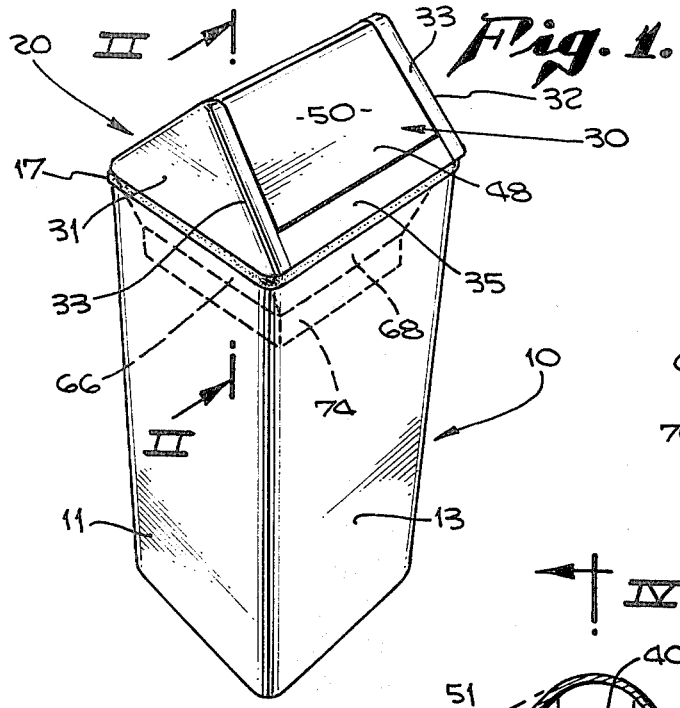
FIG. 1 is a perspective view of the cover of the present invention mounted on a waste receptacle.
Figure 2:
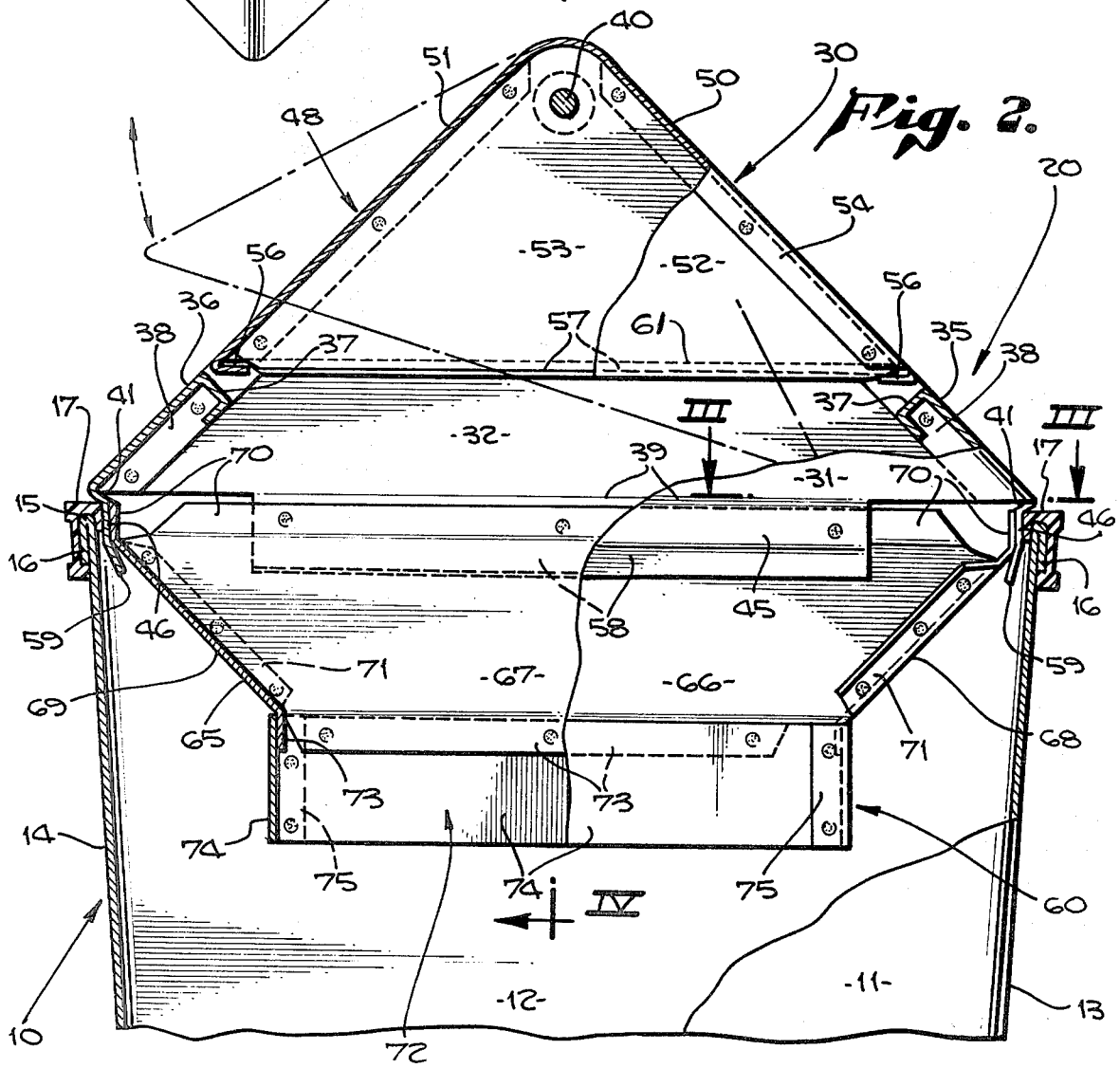
FIG. 2 is a cross section of the cover of the present invention taken through plane II—II of FIG. 1.
Figure 4:
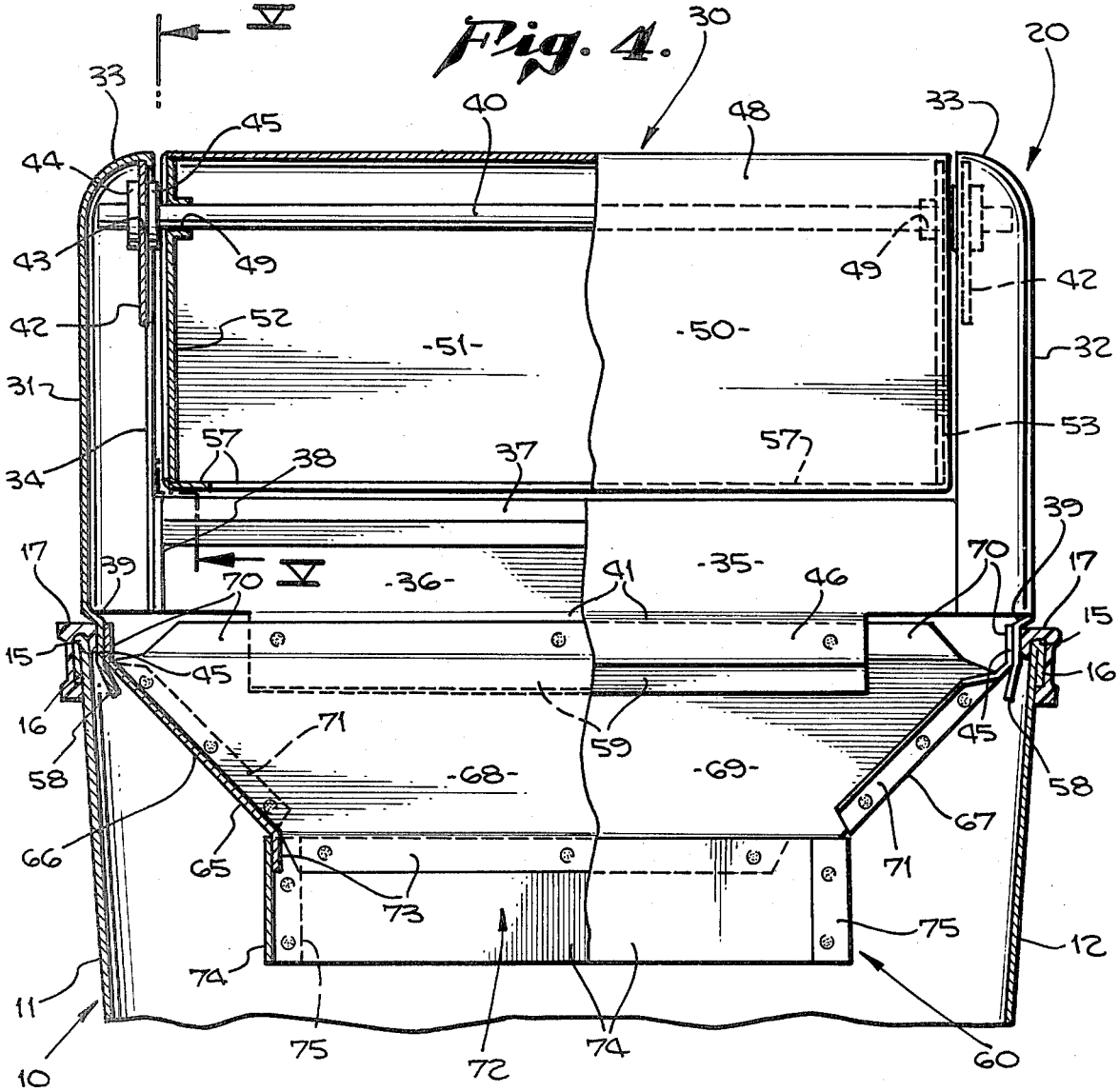
FIG. 4 is a cross-sectional view taken through plane IV—IV of FIG. 3.

The present invention includes a cover 20 for waste receptacle 10. As shown in FIGS. 1, 2 and 4, receptacle 10 includes a bottom (not shown) and four sidewalls 11, 12, 13 and 14. Preferably, the bottom and sidewalls are formed of sheet metal which can be formed to the shape desired. Sheet metal is preferable because it will not burn. Although the receptacle and the cover could both be formed out of plastic, plastics can burn if exposed to a high enough temperature, and the combustion products may contain noxious or poisonous gases such as phosgene. Therefore, metal is by far the safest material. For cost, ease of assembly and strength, painted sheet steel is the chosen material.

Preferably, the receptacle is formed in three pieces, two pieces each comprising one sidewall and half of each of the two adjacent sidewalls. The joining edges of the half sidewalls are either spot welded or otherwise attached to each other. The bottom fits within the sidewalls and it is spot welded to the inside of the sidewalls. The bottom may have metal or rubber feet.

Each sidewall has an upper sidewall edge 15 which is formed by a bent-over portion 16. The upper sidewall edge therefore extends along the tops of each of the sidewalls about the opening of the receptacle. In the exemplary embodiment, a length of extruded plastic or rubber 17 is fitted onto sidewall edge 15 and also runs the entire length of the sidewall edge. Preferably, the two ends of plastic edging 17 are glued or otherwise attached to each other at their joint along the edge 15 of one of the sidewalls. The plastic edging acts as a bumper and has other functions which will be described hereinafter.

Cover 20 comprises an upper cover 30, most of which extends above the upper sidewall edge 15 and a lower cover portion 60 below upper cover portion 30.

Upper cover portion 30 comprises a pair of upright supports 31, 32 extending generally upward from edge 15 of opposing sidewalls 11, 12 (FIG. 4). Because cover 20 has a generally square projection and receptacle 10 also has a square projection, cover 20 could be rotated 90° so that the upright supports could rest on the upper sidewall edge of sidewalls 13 and 14. As shown in FIG. 1, each upright support is generally triangular in shape and has a curved surface 33 along the sides of the triangle. The curved surfaces are formed by bending or forming in a known manner.

Side means support the upright supports generally parallel to each other and spaced apart. In the exemplary embodiment, the side means comprise two strips 35 and 36. Each strip is formed of metal and has ends that are bent at 37 for strength and to eliminate sharp edges. Strips 35 and 36 are also bent at 38 along the sides of the strips to attach them to edge 34, which is bent inward from curved surface 33 of the upright supports. Bent portion 38 is attached to edge 34 by means of spot welding or other known attaching means.

Figure 5:
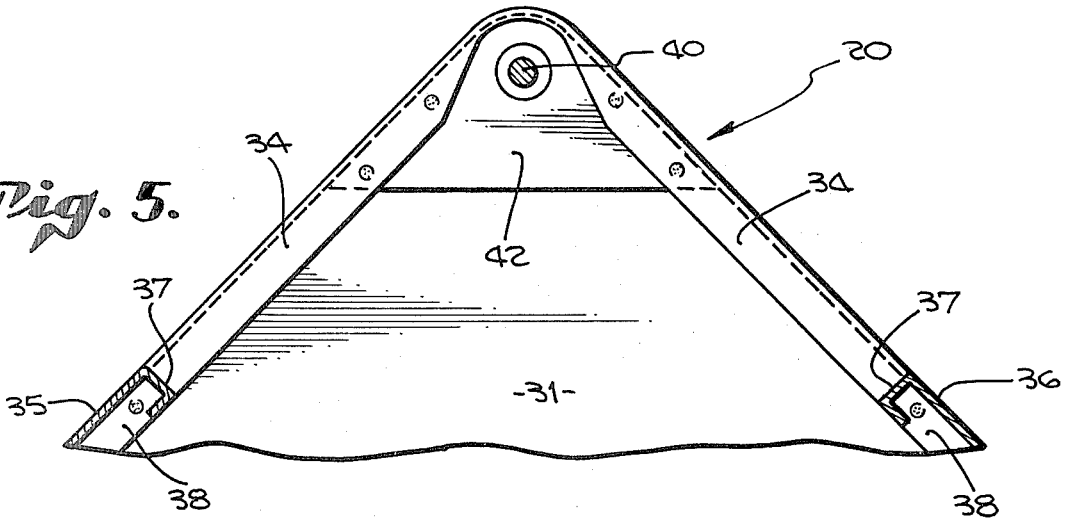
FIG. 5 is another sectional view taken through plane V—V of FIG. 4.

An axle extends between the upright supports, and a swinging top swings on the axle. In the exemplary embodiment, especially as shown in FIGS. 4 and 5, axle 40 extends between upright walls 31 and 32. Axle support plate 42 is welded to the inside of edge 34. Axle 40 extends through hole 43 in support plate 42, and washers 44 and 45 are mounted on either side of support plate 42. The axle is sufficiently long that even if it slid axially and contacted one of the upright supports 31, 32, it would still not come out of the opposite hole 43.

Swinging top 48 is mounted on axle 40. The swinging top is preferably formed of one sheet of metal which is bent to a triangular shape when viewed from FIG. 2. As shown in FIG. 2, this triangular shape conforms to the triangular shape of upright supports 31 and 32. The bent sheet which forms the outside of the swinging top forms outside walls 50 and 51 (FIG. 2). The swinging top also includes triangularly shaped sidewalls 52 and 53 which are welded or otherwise attached to the inside of bent-over portion 54 of walls 50 and 51.

As best seen in FIG. 4, sidewalls 52 and 53 of the swinging top have openings which are punched through the sheet metal at 49, and axle 40 extends through the openings 49. Openings 49 are of a large enough diameter that top 48 is free to swing on axle 40 which in turn is supported by upright supports 31 and 32 by means of axle support plates 42. Previously mentioned washers 45 correctly position swinging top 48 on the axle relative to axle support plates 42 and allow the top to swing. In lieu of the single washers 45, more than one may be used at each end of the swinging top to reduce friction.

Walls 50 and 51 of swinging top 48 have bottom bent portions 56 to eliminate the risk of cutting one's hands on a metal edge. Likewise, sidewalls 52 and 53 of swinging top 48 also have bent portions 57.

If desired, a horizontal base or bottom wall can be mounted along the bottom of the swinging top to seal the volume of the swinging top from the receptacle. The horizontal base 61 in the exemplary embodiment is supported on bent portions 56 and 57 of walls 50, 51 and 52 of the swinging top, and covers the entire bottom. This prevents air that would be contained in the swinging top from entering the receptacle to feed a fire.

It should be noted that walls 50 and 51 extend almost to the top edges of sidewalls 35 and 36. Enough clearance is provided so that the bottom edges of walls 50 and 51 will not contact bent portions 37 when the top swings. Because the center of gravity of swinging top 48 is below axle 40, the swinging top hangs in the position shown in FIG. 1. Pushing on walls 50 or 51 will pivot the swinging top about the axle so that waste can be dropped into the receptacle. In FIG. 2, the swinging top is shown in solid in its normally closed position, and one of the open positions is shown in phantom.

The cover 20 further comprises a lower portion 60. The lower portion includes a baffle 65 including angled baffle walls 66–69 depending from the upright supports and from the side means. As shown in FIG. 2, angled baffle walls 68 and 69 depend from side means 35 and 36, and in FIG. 4, angled baffle walls 66 and 67 depend from upright supports 31 and 32. As shown in FIG. 2, side means 36 and 37 each have an inwardly extending portion 41 from the bottom of the side means and a short vertical portion 46 extending from the inwardly extending portion 41. Likewise, inwardly extending portion 39 extends from each of the upright supports 31 and 32, and a vertical portion 45 extends from the inwardly extending portion 39. As shown in FIGS. 2 and 4, inwardly extending portions 41 and vertical extending portions 46 form a shoulder or recess which rests on plastic edging 17 on the upper sidewall edge of the receptacle. Likewise, inwardly extending portions 39 and vertical extending portions 45 also form a shoulder which rests on plastic edging 17.

Angled baffle walls 66–69 each have an upright vertical portion 70 which is spot welded to one of the vertical portions 45, 46 to attach the baffle 65 and the lower cover portion 60 to the upper cover portion 30.

Figure 3:
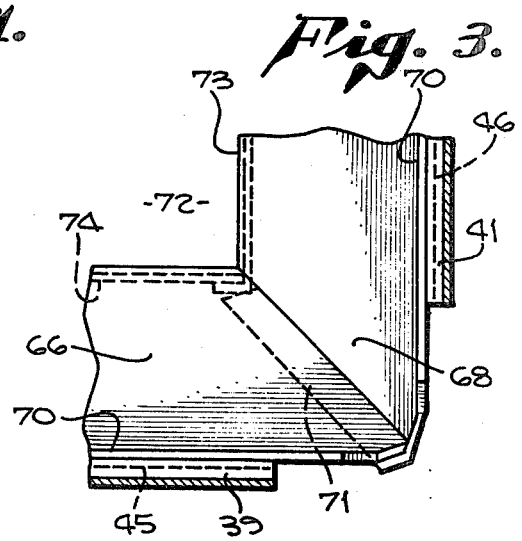
FIG. 3 is a cross section through III—III of FIG. 2.

Each of the angled baffle walls 66–69 has a side extension 71 on one end. Each side extension is spot welded or otherwise attached to the adjacent angled baffle walls (FIG. 3).

At this point, the baffle would have some effectiveness in slowing or extinguishing fires in the receptacle. It is believed that the angled baffle walls 66–69 direct the rising combustion products back onto the flammable material and prevent or limit the amount of air entering the opening formed by the baffle. Moreover, the flow of air is restricted because of the upper cover portion.

Efficiency to extinguish the fire is improved by adding vertical baffle walls extending generally vertically from the angled baffle walls. As shown primarily in FIGS. 2 and 4, the angled baffle walls angle toward each other leaving a baffle opening 72 through which waste can be thrown into the receptacle.

The vertical baffle walls 74 are spot welded to the downward extending portion 73 of angled baffle walls 66–69. Each vertifal baffle wall 74 has a side extension 75 which is welded or otherwise attached to the adjacent vertical baffle wall. Therefore, the vertical baffle walls are connected in such a way to comprise a rectangular or square box with open top and bottom. The box-like structure permits waste to drop through opening 72 into the receptacle, and the vertical baffle walls 74 improve the flow of carbon dioxide and other waste gases onto the burning material.

For reasons primarily set forth above, the aforementioned parts are all metal, preferably sheet steel which may be painted or otherwise treated to resist rust. Metal will not burn as plastic will. Sheet steel can easily be welded through the use of spot welding or other welding techniques, and it is relatively easily formed to the shapes desired through conventional bending and forming techniques.

Depending from the recess formed by portions 39 and 45 (FIG. 4) is a cam surface 58, and depending from the recess formed by portions 41 and 46 is a cam surface 59. Cam surfaces 58 and 59 help guide the recess to rest on edging 17 when the cover 20 is replaced on the receptacle. Because they are metal, the camming surfaces 58 and 59 can bend somewhat inwardly to guide the recess onto the plastic edging. This eliminates the need for having to place the cover in the exact orientation; camming surfaces 58 and 59 will guide the cover to the correct location.

As discussed above, vertical portion 70 of angled baffle walls 66–69 are attached to downwardly extending portions 45 and 46 in such a way that vertical portion 70 does not interfere with the camming effect of camming surfaces 58 and 59. The location of the attaching permits all of the baffle to be low, generally within the receptacle to have increased efficiency in slowing or extinguishing fires. Moreover, during pivoting of the swinging top 50, the lower edge of walls 50 and 51 may extend below the top of the edge 15 of the receptacle. If the angled baffle walls were too high, they might interfere with the swinging top. Therefore, it is desirable to have the baffle low, away from the swinging top.

It will be understood that various modifications and changes may be made in the configuration described above which may come within the spirit of this invention, and all such changes and modifications coming within the scope of the appended claims are embraced thereby.

I claim:

1. A cover for a waste receptacle having upright sidewalls, each sidewall having an upper sidewall edge about the opening of the receptacle, the cover comprising an upper portion comprising a pair of upright supports extending generally upward from opposing upper sidewall edges, side means for supporting the upright supports generally parallel to each other and spaced apart, an axle between the upright supports, a swinging top swinging on the axle extending between the upright supports to cover the opening, the cover further including a lower portion comprising a baffle comprising angled baffle walls depending from the upright supports and from the side means toward each other and leaving a baffle opening extending into the receptacle, the swinging top including two angled sides intersecting each other, the angled sides normally extending to the side means and to the upright supports to cover the opening, the swinging top further including a generally horizontal base along the bottom of the swinging top to seal the volume of the swinging top from the receptacle.

2. The cover of claim 1 further comprising generally vertical baffle walls extending generally vertically from the angled baffle walls.

3. The cover of claim 1, wherein the side means and the upright supports each have a recess near their lower edges which rests on the upper sidewall edges of the receptacle, and guide walls extending below the recesses for guiding the cover into its correct orientation on the receptacle.

4. The cover of claim 3 further comprising means for attaching the angled baffle walls to the inside of the side means and the upright supports below the recess.

* * * * *